US010345067B2

(12) United States Patent
Brown

(10) Patent No.: US 10,345,067 B2
(45) Date of Patent: Jul. 9, 2019

(54) FIREARM BOLT CONFIGURED TO PREVENT THE FIRING OF A CONVENTIONAL CARTRIDGE

(71) Applicant: AMTEC Less Lethal Systems, Inc., Perry, FL (US)

(72) Inventor: Tyler W. Brown, Milton, WI (US)

(73) Assignee: AMTEC Less Lethal Systems, Inc., Perry, FL (US)

( * ) Notice: Subject to any disclaimer, the term of this patent is extended or adjusted under 35 U.S.C. 154(b) by 0 days.

(21) Appl. No.: 15/647,571

(22) Filed: Jul. 12, 2017

(65) Prior Publication Data

US 2018/0017348 A1 Jan. 18, 2018

Related U.S. Application Data

(60) Provisional application No. 62/361,011, filed on Jul. 12, 2016.

(51) Int. Cl.
*F41A 3/12* (2006.01)
*F41A 17/42* (2006.01)
*F41A 3/68* (2006.01)

(52) U.S. Cl.
CPC ..... *F41A 17/42* (2013.01); *F41A 3/12* (2013.01); *F41A 3/68* (2013.01)

(58) Field of Classification Search
CPC ..... F41A 17/42; F41A 3/12
USPC ..... 102/469, 470, 472
See application file for complete search history.

(56) References Cited

U.S. PATENT DOCUMENTS

| | | | | |
|---|---|---|---|---|
| 2,321,737 | A | 12/1899 | Engel | |
| 976,459 | A | 11/1910 | Hartmann | |
| 3,120,186 | A | 2/1964 | Harvey et al. | |
| 3,217,441 | A | 11/1965 | William et al. | |
| 3,237,335 | A | 3/1966 | William et al. | |
| 3,501,858 | A * | 3/1970 | Hensley | F41A 3/12 102/433 |
| 4,442,777 | A | 4/1984 | Greene | |
| 4,478,128 | A * | 10/1984 | Black | F41A 1/04 102/440 |
| 5,880,397 | A | 3/1999 | Crilly | |
| 6,612,063 | B1 * | 9/2003 | Sigg | F41A 3/12 102/430 |
| 6,625,916 | B1 | 9/2003 | Dionne | |
| 7,021,219 | B1 | 4/2006 | Dindl | |
| 8,430,035 | B2 | 4/2013 | Ducastel, Jr. | |
| 8,484,876 | B2 * | 7/2013 | Mossberg | F41A 9/54 42/70.01 |
| 8,782,938 | B2 | 7/2014 | Teach, Jr. et al. | |
| 9,217,626 | B1 | 10/2015 | Hajjar | |
| 2003/0145754 | A1 | 8/2003 | Saxby | |

(Continued)

FOREIGN PATENT DOCUMENTS

DE 1578388 * 3/1971

OTHER PUBLICATIONS

PCT Written Opinion for PCT/US17/41662, dated Jan. 15, 2019.

*Primary Examiner* — Stephen Johnson
(74) *Attorney, Agent, or Firm* — Remenick PLLC

(57) ABSTRACT

A firearm configured to fire only a modified cartridge, while being unable to fire a conventional cartridge. The breech bolt in the inventive device includes an added geometric element that prevents the bolt closing on a conventional cartridge and which will only allow the bolt to close on a modified cartridge.

17 Claims, 15 Drawing Sheets

(56) References Cited

U.S. PATENT DOCUMENTS

| | | | | |
|---|---|---|---|---|
| 2004/0231549 | A1 | 11/2004 | LaMaster | |
| 2011/0203151 | A1* | 8/2011 | Mossberg | F41A 9/54 42/70.01 |
| 2012/0324774 | A1* | 12/2012 | Zedrosser | F41A 3/12 42/2 |
| 2013/0255126 | A1 | 10/2013 | Saxby | |
| 2015/0101228 | A1 | 4/2015 | Giannini et al. | |

* cited by examiner

FIREARM BOLT CONFIGURED TO PREVENT THE FIRING OF A CONVENTIONAL CARTRIDGE

CROSS-REFERENCES TO RELATED APPLICATIONS

Pursuant to the provisions of 37 C.F.R. § 1.53(c), this non-provisional patent application claims the benefit of a previously filed provisional application. The provisional application was filed on Jul. 12, 2016 and assigned application Ser. No. 62/361,011. The provisional application named the same inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

The invention relates to the field of firearms. More specifically, the invention comprises a bolt having a geometric element that prevents the bolt closing on a conventional cartridge and which will only allow the bolt to close on a modified cartridge.

2. Description of Related Art

The present invention may be adapted for use in a wide variety of firearms, including centerfire shotguns, rifles, and pistols. The invention may also be used with many other devices that use an explosive charge to launch a projectile, including grenade launchers. The invention is particularly suited for use with firearm bolts having a linear motion (as opposed to break-action designs). Such bolts are found in pump-action shotguns, semi-automatic shotguns, slide-action rifles, bolt-action rifles, semi-automatic rifles, and semi-automatic pistols. The illustrations in this disclosure focus on pump-action shotguns, as this type of weapon is widely used in the law-enforcement community. However, the reader should bear in mind that the invention may be used in other types of weapons and non-weapon launchers as well.

FIG. 1 depicts a bolt assembly from a pump-action shotgun. This specific example comes from a Remington Model 870. Bolt assembly 8 includes breech bolt 10, locking toggle 12, extractor 20 and other components (such as a firing pin and firing pin spring). Bolt face 16 bears against the base of a cartridge that is loaded in the weapon. The bolt face includes firing pin aperture 18. The firing pin itself is housed internally. It normally rests in a retracted position and therefore is not visible from the vantage point shown in FIG. 1. However, when the firing pin is struck by the weapon's hammer, the nose of the firing pin is propelled forward through firing pin aperture 18 to strike the primer on a cartridge.

As those skilled in the art will know, breech bolt 10 must be locked in the closed position before the weapon can be fired (It is true that some weapons lire from an open bolt, but this is the exception and such a configuration is not shown in the views.). Locking toggle passage 14 passes through breech bolt 10 from top to bottom. Locking toggle 12 resides in this passage. Locking toggle 12 is employed to secure breach bolt 10 in the closed position and to perform other functions.

Extractor 20 is also connected to breech bolt 10. This claw-like component engages the rim on the base of a cartridge and pulls the cartridge out of the firing chamber when the bolt is moved rearward toward the open position. Other conventional features are also included in the bolt assembly. As these are well understood by those skilled in the art, they have not been depicted or described in more detail.

FIG. 4 depicts a prior art shotgun shell 32. Metallic shot is typically contained within a shot cup in hull 34. Head 38 is traditionally brass but is now more commonly made of steel. It includes base 40 and rim 42. Primer 36 is located in the center of base 40. The primer is a percussion-initiated device. When the shell is chambered in a shotgun, the striking of the primer by the firing pin fires the shell.

FIG. 5 shows a sectional view through the shotgun shell of FIG. 4. The hull is now commonly made of molded plastic. In the version shown, hull wall 46 and base wad 44 are molded as one integral piece. Head 38, base 40, and rim 42 are created by deforming one piece of metal. This metallic piece is deformed around the molded polymer of base wad 44. The same metallic piece is often deformed into primer pocket 48 (which also extends into the base wad). Primer 36 is pressed into primer pocket 48. The primer is typically retained by friction, although sealing lacquer placed over the aft end of the assembly may also assist in the retention of the primer.

Propellant 50 is retained within wall 46 forward of the base wad. As those skilled in the art will know, when a firing pin strikes primer 36 the primer shoots burning gas into propellant 50 and ignites the shell. The burning propellant then forces the shot cup and projectiles down the bore and out of the weapon.

The shotgun shell construction shown in FIGS. 4 and 5 is one example among many different types in use. Older shells use waxed paper for the hull and brass for the base wad. Newer shells use injection-molded plastic for the hull and the head. In fact, the use of metal for the head portion of the shell in modern designs is largely a nod to tradition. The metallic portion in many instances is a decorative overlay, with the molded plastic base wad providing most of the required structural integrity.

Shotgun shells have traditionally been thought of as a "lethal force" device, meaning that they possess the ability to kill a human or animal target. Even when smaller shot sizes are used (#7 and higher) a shotgun shell has the capacity to kill at close range. Now, however, non-lethal, and "less-lethal" shotgun shells have been developed for crowd control and other purposes. Some of these shells employ soft projectiles and other means to deliver a stunning blow without the potential for the creation of a fatal wound. These cartridges may be generally referred to as "less-lethal cartridges."

Less-lethal cartridges are currently fired from the same firearms used for lethal cartridges and this feet has created unintended results. In a situation where an individual or crowd of individuals must be engaged and subdued, police officers are acting quickly and in a heightened emotional state. In such a situation it is possible for an officer to accidentally load a lethal shotgun cartridge instead of the less-lethal cartridge he or she intended to load. The mistake may not be discovered until the weapon is fired.

It is desirable to provide a weapon for delivering a less-lethal/non-lethal cartridge that cannot be used to discharge a lethal cartridge. The present invention provides such a solution.

BRIEF SUMMARY OF THE INVENTION

The present invention comprises a firearm configured to fire only a modified cartridge, while being unable to fire a conventional cartridge. The breech bolt in the inventive device includes an added geometric element that prevents the bolt closing on a conventional cartridge and which will only allow the bolt to close on a modified cartridge. The invention is particularly suited to firearms having a linearly reciprocating breech bolt, such as a pump-action shotgun. In the preferred embodiments, the face of the breech bolt is provided with a ring-shaped protrusion. The protrusion is centered on the central axis of the firing pin. A modified cartridge is provided with a ring-shaped recess in its base. The recess is sized and positioned to receive the ring-shaped protrusion on the bolt face, thereby allowing the bolt face to rest against the base of the modified cartridge as the bolt closes and locks in the firing position.

The inventive breech bolt is unable to close on a conventional (lethal) cartridge. In the case of a conventional cartridge, the ring-shaped protrusion on the bolt face of the preferred embodiment will bear against the cartridge base before the bolt has traveled forward to the locked position. A substantial gap between the bolt face and the base of a conventional cartridge is thereby created. Even if the firing pin is actuated, the nose of the firing pin will not be able to reach the primer of a conventional cartridge across this gap. Further, as most firearms contain a mechanism preventing discharge when the bolt is open, it is likely that the firing pin will not be actuated when the gap is present.

Thus, the inventive firearm is able to fire a modified cartridge but unable to fire a conventional (lethal) cartridge. On the other hand, the modified cartridge may preferably be fired in either an inventive firearm or a conventional firearm.

REFERENCE NUMERALS IN THE DRAWINGS

Figure 1:
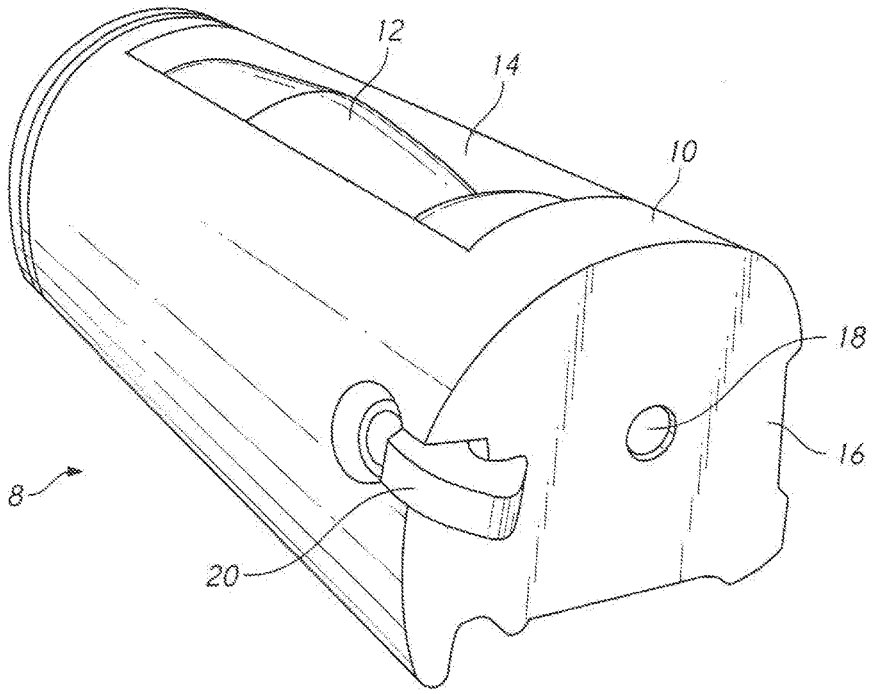
FIG. 1 (PRIOR ART)
FIG. 1 is a perspective view, showing a prior an shotgun bolt assembly.

8 bolt assembly
10 breech bolt
12 locking toggle
14 locking toggle passage
16 bolt face
18 firing pin aperture
20 extractor
22 ring protrusion
24 firing pin
26 flange
28 compression spring
30 counter bore
32 shotgun shell
34 hull
36 primer
37 head
40 base
42 rim
44 base wad
46 wall
48 primer pocket
50 propellant
52 ring recess
54 barrel
56 firing chamber
58 nose
60 barrel extension
62 receiver
63 locking recess
64 locking lug
66 slide lug
68 action bar
70 forend
72 closing cam
74 magazine tube
76 angled wall
78 angled wall
80 fillet
82 recess
84 insert
86 head extension
88 supplemental standoff

DETAILED DESCRIPTION OF THE INVENTION

The present invention may be adapted for use in a wide variety of centerfire firearms. It is particularly suited to those firearms having a linearly reciprocating breech bolt. Thus, it could be applied to pump shotguns, semi-automatic shotguns, semi-automatic pistols, slide-action rifles, straight-pull rifles (such as the Blaser), and semi-automatic rifles, among other types. Exemplary shotgun applications include the Remington 870 pump shotgun, the Remington 1100-series semi-automatic shotguns, the Winchester SXP pump shotgun, the Browning Auto 5 semi-automatic shotgun, the Mossberg 500, and the Benelli Black Eagle-series shotguns. Because the Remington 870 is widely used in law enforcement, it is used in the attached illustrations. However, those skilled in the art will readily appreciate how the invention could be applied to many other firearm models and types.

As explained previously, FIG. 1 shows a prior art bolt assembly 8 such as used in the Remington Model 870 shotgun. FIG. 2 shows the same bolt assembly modified according to the present invention. Ring protrusion 22 is added to bolt face 16. The ring protrusion is preferably centered on the central axis of firing pin aperture 18. The ring's diameter is large enough to completely avoid the primer of a conventional cartridge.

Figure 3:
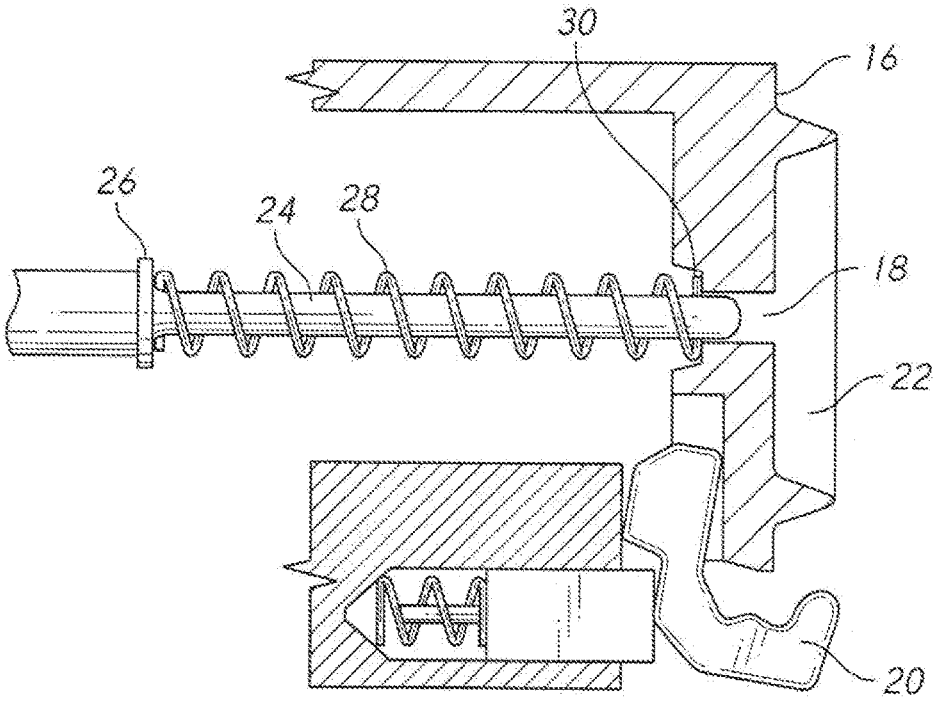
FIG. 3 is a sectional top view of the inventive bolt assembly.

FIG. 3 shows a sectional top view taken through the mid-plane of the bolt assembly. Firing pin 24 rests within the bolt assembly, with the nose of the firing pin being recessed within firing pin aperture 18. Compression spring 28 is a coil spring located over the forward portion of the firing pin. It is compressed between flange 26 and counterbore 30. The rear portion of the firing pin (not shown) is engaged by a journal in the breech bolt and thereby prevented from exiting the breech bolt. Compression spring 28 remains in compression even when the firing pin is in a resting state (as shown) thereby ensuring that the nose of the firing pin remains behind the bolt face. When the trigger is pulled and the rear portion of the firing pin is struck by the shotgun's hammer, the nose of the firing pin is forced beyond the bolt face and it will then strike the primer of a cartridge that is present in the firing chamber. The compression spring then urges the firing pin back toward the retracted position shown. This type of arrangement is sometimes referred to as a "rebounding" firing pin action. It is present in the vast majority of modern firearms.

Figure 4:
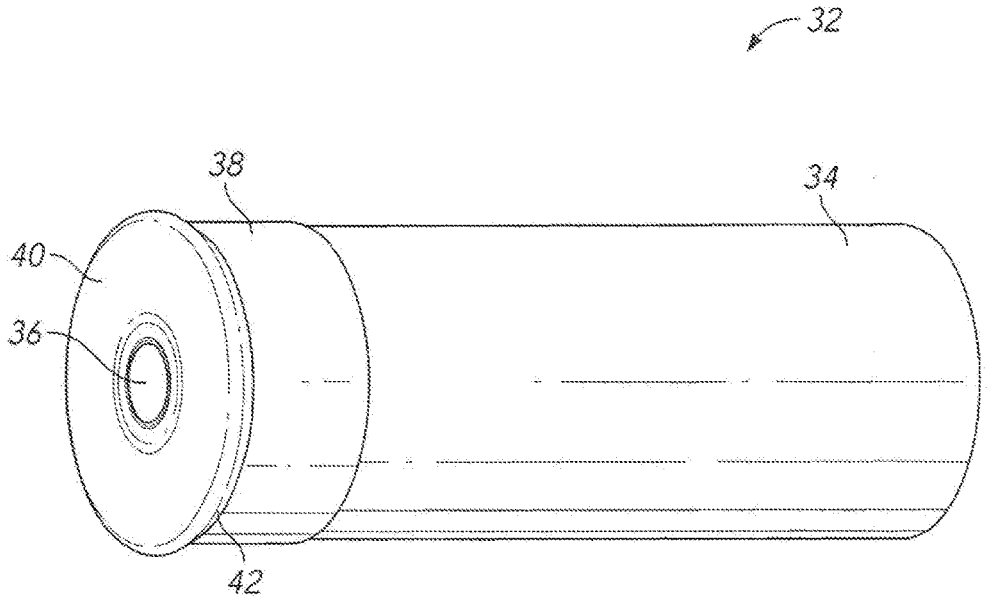
FIG. 4 (PRIOR ART)
FIG. 4 is a perspective view, showing a prior art shotgun shell.
Figure 5:
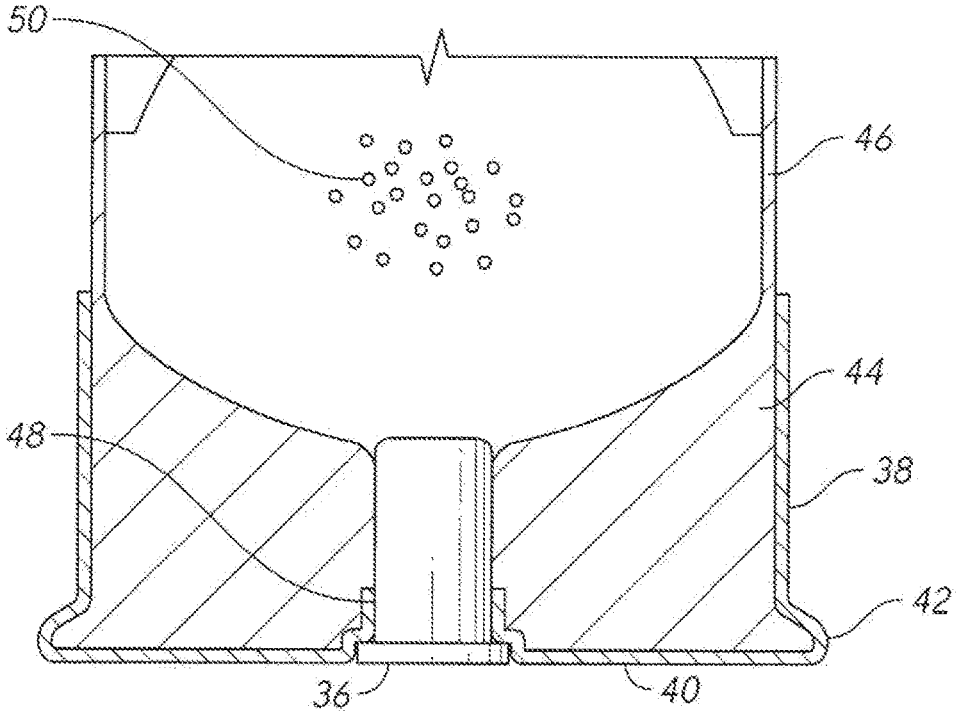
FIG. 5 (PRIOR ART)
FIG. 5 is a sectional elevation view, showing some internal details of the prior art shotgun shell.

Still looking at FIG. 3, the reader will observe that ring protrusion 22 extends significantly forward of bolt face 16. The reader will also observe that the inner diameter of the ring protrusion is larger than the outer diameter of a primer used on a conventional centerfire shotgun cartridge. FIG. 4 shows a typical prior art shotgun shell 32. Primer 36 is located in the central portion of base 40. Ring protrusion 22 is configured to lie outside the region of the primer.

Figure 6:
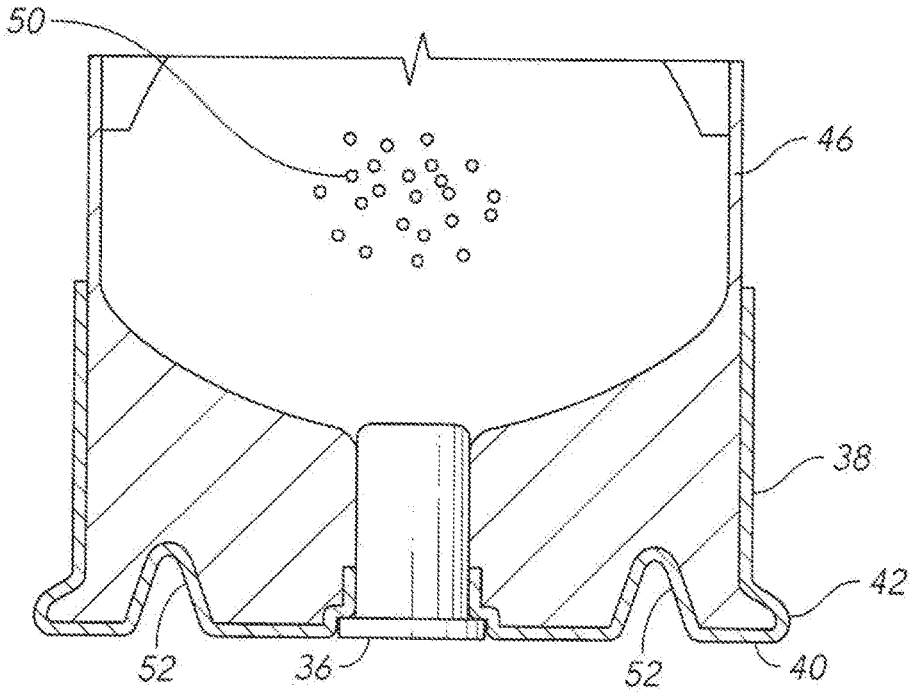
FIG. 6 is a sectional elevation view, showing some internal details of a shotgun shell modified according to the present invention.

The inventive breech bolt of FIG. 3 requires a modified shotgun cartridge in order for the bolt assembly to close, lock, and fire. FIG. 6 shows an example of such a modified cartridge. Its general construction is the same as for the prior art cartridge described previously. It includes a hull and a head. The shape of base 40 is modified, however. The flat surface of the base opens into ring recess 52. Ring recess 52 is an annular recess that is generally centered on primer 36. The reader will note from the shape of ring recess 52 that it is configured to receive the ring protrusion on the inventive bolt face.

Figure 7:
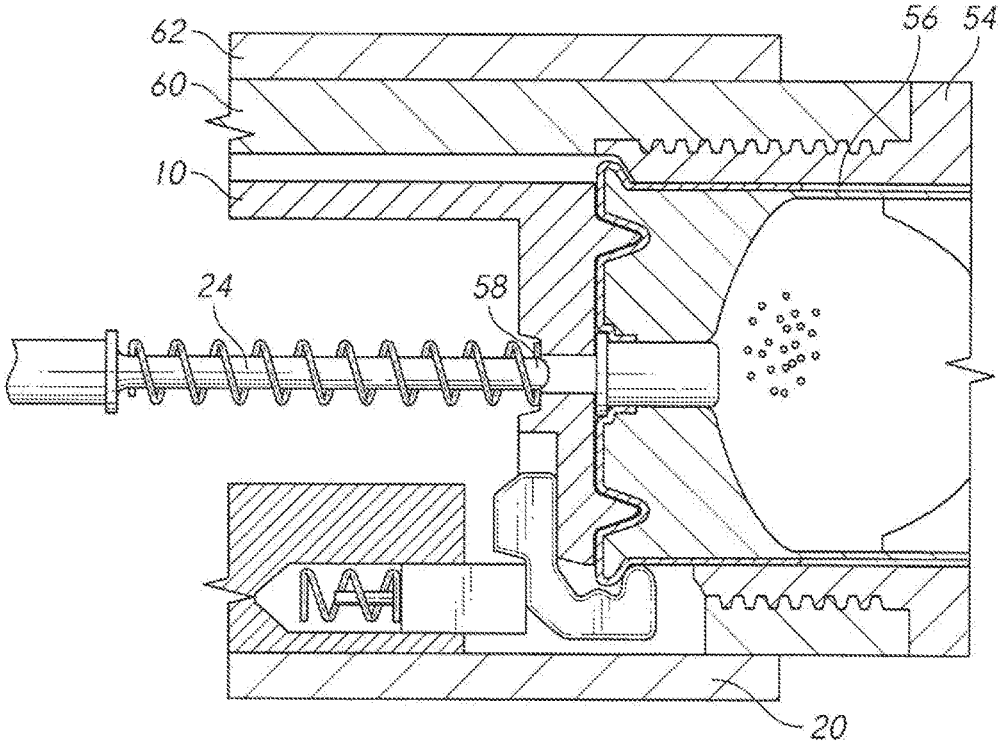
FIG. 7 is a sectional top view of the inventive bolt assembly in the closed position with an inventive shotgun shell chambered and ready to fire.

FIG. 7 shows a sectional view (looking from the top down) through a firearm modified with the inventive bolt assembly. The firearm is again a Remington Model 870. A shotgun shell—modified as shown in FIG. 6—is chambered within firing chamber 56 in barrel 54. Shotgun shells are located longitudinally by the forward face of the shell's rim mating against the rearward-facing surface of a counterbore at the very rear of the firing chamber (The counterbore is commonly known as a "rim relief"). In the Model 870 design barrel 54 threads into barrel extension 60 as shown. Barrel extension 60 is connected to receiver 62. Breech bolt 10 cycles within receiver 62 (cycles from right to left and back again, with respect to the vantage point shown in the view).

As is known to those skilled in the art, breech bolt 10 mechanically locks to barrel extension 60 in order to secure the bolt for firing. Receiver 62 is largely non-structural. Instead, it serves to guide the motion of the bolt assembly and to mount other necessary items such as the trigger group and shell feeding mechanisms. FIG. 7 shows breech bolt 10 closed and ready to fire. Ring protrusion 22 rests within the ring recess on the base of the modified cartridge. As a result, the bolt face rests directly against the base of the modified cartridge. This is the conventional position for a locked bolt and a cartridge that is ready to fire. If the trigger of the weapon is pulled at this point, the hammer will be released and it will strike the rear portion of the firing pin. Firing pin 24 will then be propelled forward and its nose will reach and strike the primer in the modified cartridge. Because the base of the cartridge is mated against the bolt face, the nose of the firing pin will easily reach and detonate the primer before returning to its "rebounded" position.

Figure 8:
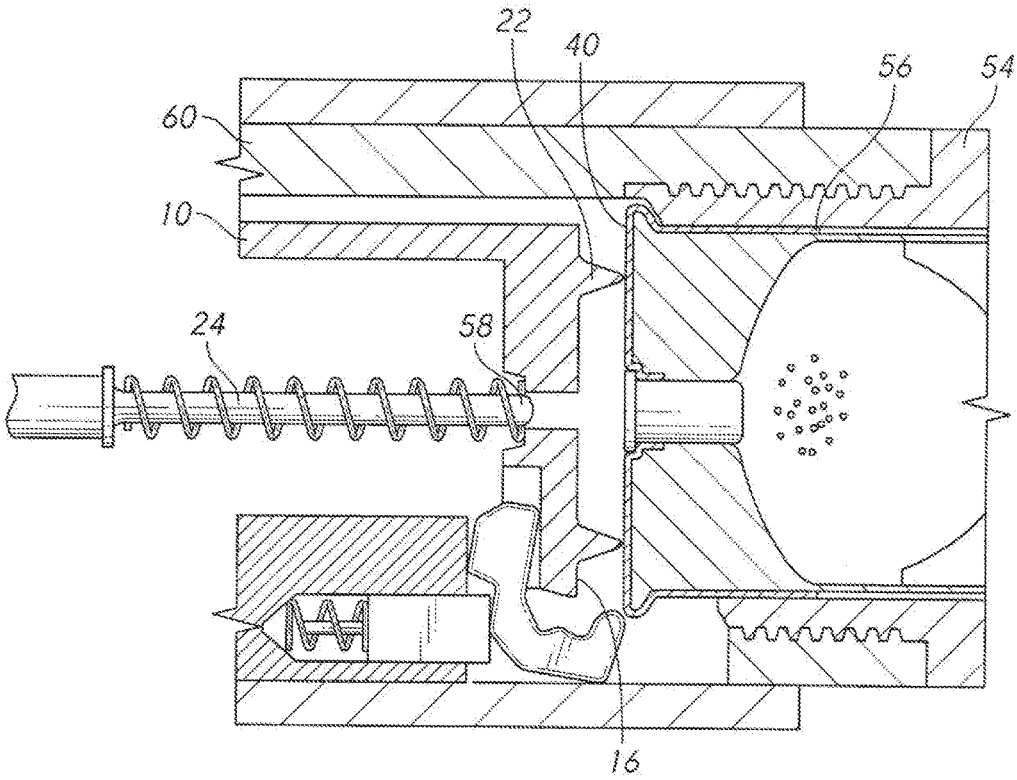
FIG. 8 is a sectional top view of the inventive bolt assembly failing to close on a prior art shotgun shell.

In contrast, FIG. 8 illustrates what happens when a conventional (unmodified) shotgun shell is placed into a firearm modified according to the present invention. The conventional shell has a flat, unmodified base 40. The forward extreme of ring protrusion 22 contacts the flat base and prevents any further forward movement of breech bolt 10. The shotgun shell itself cannot move forward because its rim is already hard against the rim reliefs rearward-facing surface. In this position, the bolt has not reached its closed and locked position. Two conditions are true in this state. First, if the hammer is somehow released to strike the firing pin, the firing pin will not extend far enough forward of the bolt face to strike the primer and detonate the cartridge. The gap between the bolt lace and the cartridge base will prevent detonation.

Second, as those skilled in the art will know, the vast majority of modern firearms incorporate mechanisms that prevent the forward movement of the firing pin when the bolt is not closed and locked. The Remington 870 shotgun used in these examples includes just such a mechanism. Thus, if the trigger is pulled in the condition shown in FIG. 8, firing pin 24 will not move significantly forward.

In the version shown in FIG. 8 it appears that the extractor claw is unable to engage the rim of an unmodified shotgun shell. It is possible to shape the extractor claw so that it engages the rim of an unmodified shell even though the bolt cannot fully close. This configuration is preferable, since it allows the operator to easily eject an unmodified shell that has been mistakenly loaded into a firearm modified according to the present invention.

Figure 9:
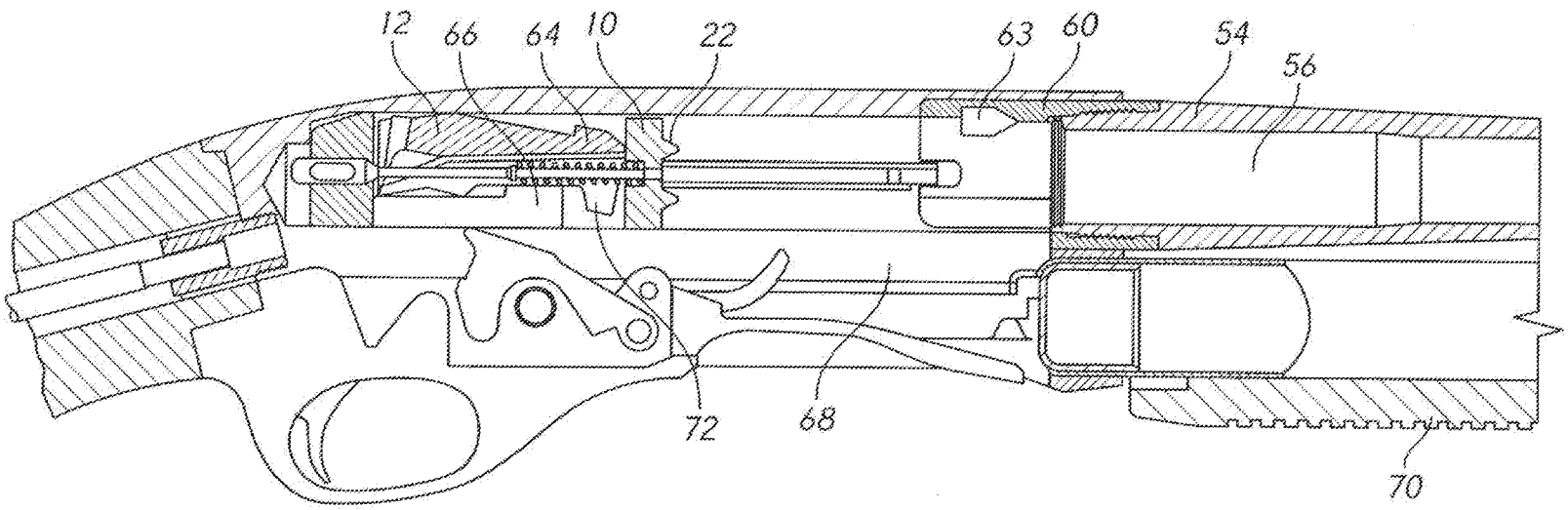
FIG. 9 is a sectional elevation view, showing the inventive bolt assembly installed in shotgun (with the bolt assembly in the fully open position).
Figure 10:
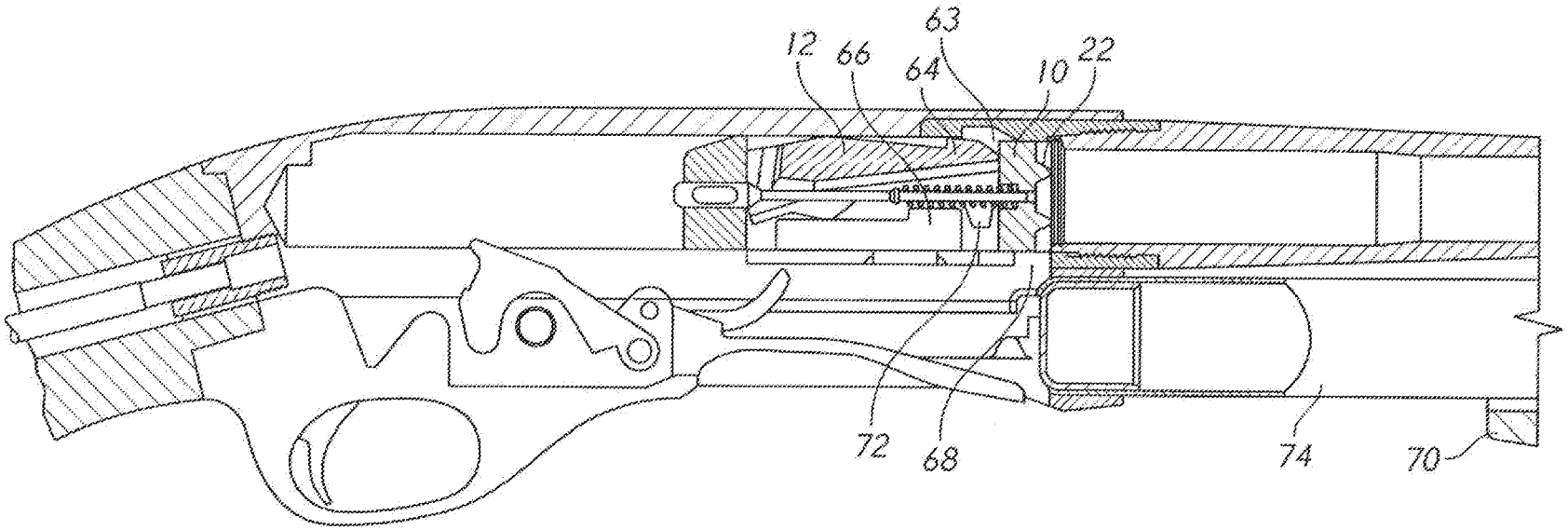
FIG. 10 is a sectional elevation view, showing the assembly of FIG. 9 with the bolt in an advance position just prior to locking closed.
Figure 11:
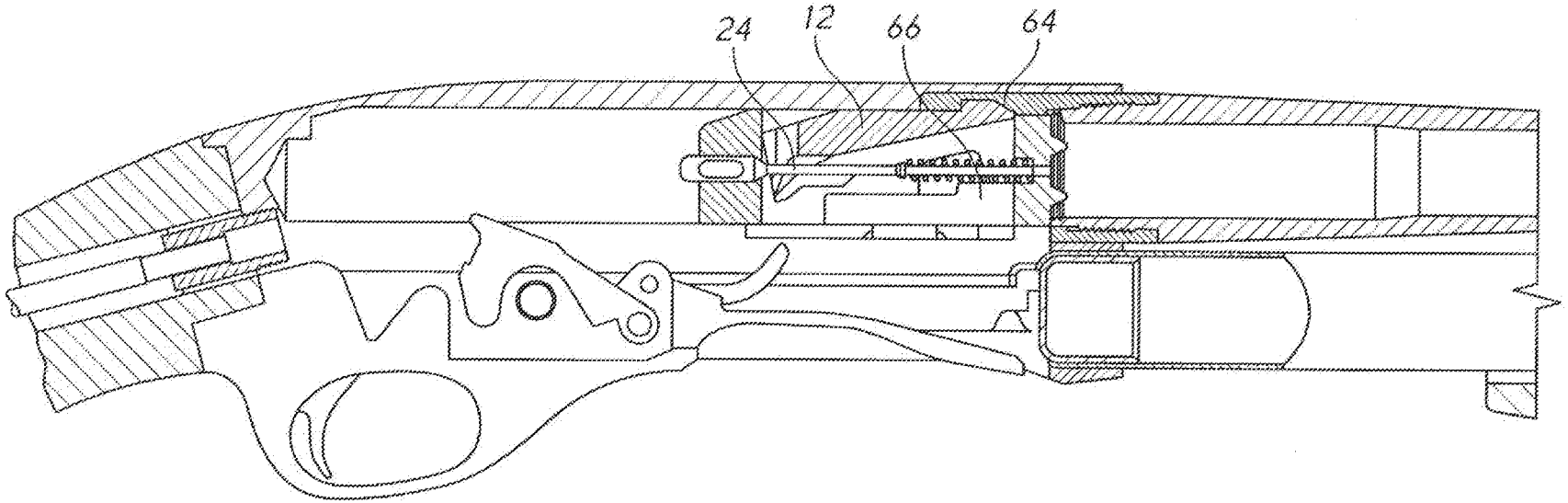
FIG. 11 is a sectional elevation view, showing the assembly of FIG. 9 with the bolt locked in the closed position.

It is helpful for the reader to understand how the invention operates in the typical chambering, firing, and ejection cycle of a firearm. FIGS. 9-11 illustrate the cycling of a Remington 870 modified according to the present invention. FIG. 9 shows a sectional elevation view of this particular shotgun (a pump-action type) with the bolt fully open. Breech bolt 10 moves left and right in the view. It is shown at its most rearward position (to the left in the view). The reader will recall that locking toggle 12 is part of the bolt, assembly and travels along with breech bolt 10. The particular breech bolt shown includes ring protrusion 22 as described previously.

A user opens the bolt on a Model 870 by grasping forend 70 and pulling it toward the rear (This assumes that the gun has been fired. If the hammer is still cocked a separate release mechanism must be actuated before the forend can be moved). Forend 70 slides forward and rearward on a cylindrical magazine tube. A pair of action bars 68 are connected to the forend. Slide lug 66—in turn—is connected to the action bars. When a user pulls the forend toward the rear, the action bars move toward the rear and carry slide lug 66 with them.

Figure 2:
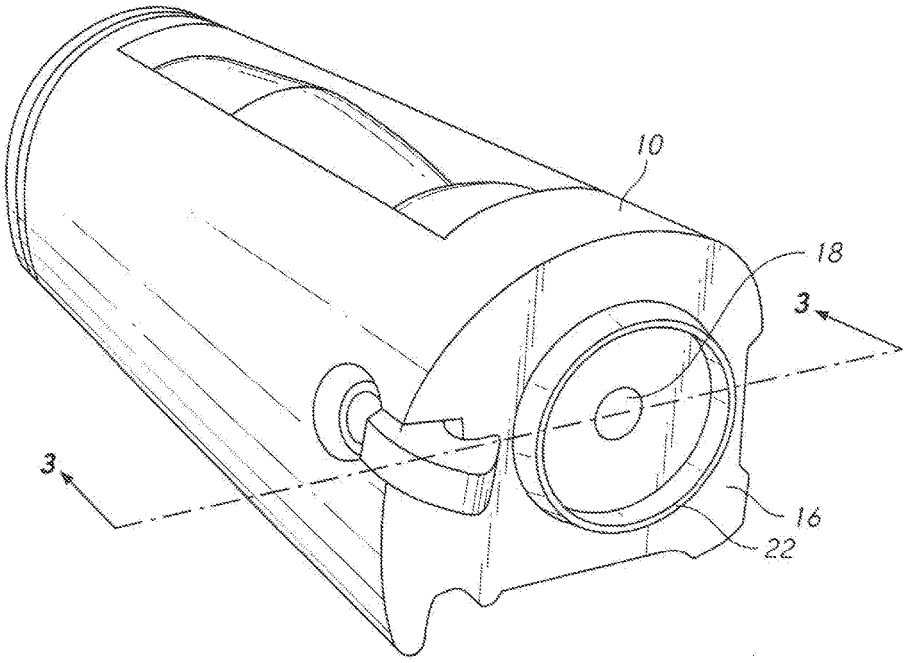
FIG. 2 is a perspective view, showing a shotgun bolt assembly modified according to the present invention.

As may be seen in the view, slide lug 66 rests within the vertical slot through breech bolt 10 (The vertical slot is labeled as locking toggle passage 14 in FIG. 1. Locking toggle 12 also rests within this passage). Still looking at FIG. 9, the reader will observe that the rear portion of slide lug 66 bears against the rear portion of breech bolt 10 as the slide lug moves rearward. This interface pulls the bolt assembly rearward until the rear portion of breech bolt 10 comes up against the rear wall of bolt slot within the receiver. Further rearward motion is then arrested.

Those skilled in the art will recall that the rearward travel of the bolt assembly also cocks the hammer and engages the sear to hold the hammer in the cocked position. Depending on the state of other user controls, a magazine latch may be actuated in this position to dispense another shell from the tubular magazine and prepare it for loading into the firing chamber. The operation of the magazine latches and a shell carrier configured to raise a dispensed shell for loading is beyond the scope of this disclosure. However, the reader wishing to further understand these mechanisms is referred to U.S. Pat. No. 2,645,873.

The state shown in FIG. 9 is after the ejection cycle and just prior to the start of a loading cycle. If the user pushes forend 70 forward, action bars 68 will urge slide lug 66 forward. The forward portion of the slide lug will bear against closing cam 72 on locking toggle 12. This will then force the locking toggle and breech bolt 10 forward.

FIG. 9 shows how barrel extension 60 extends rearward from barrel 54 and into the action. Barrel extension 60 includes locking recess 63. Locking recess 63 is shaped to receive locking lug 64 on the forward portion of locking toggle 12. It is this interface that locks the bolt in place for firing.

FIG. 10 shows the loading cycle as breech bolt 10 has moved forward and just prior to locking closed. As the user urges the forend forward along magazine tube 74 the leading portion of slide lug 66 bears against closing cam 72 on the bottom surface of locking toggle 12. The interface between slide lug 66 and closing cam 72 pushes locking toggle 12 forward and simultaneously urges the leading portion of the locking toggle upward. However, since locking lug 64 has not advanced far enough forward to pop up and into locking recess 63, locking toggle 12 remains in the depressed position shown.

If a conventional round is resting in the firing chamber at the position shown in FIG. 10, ring protrusion 22 on the bolt face will push against the flat base of the cartridge and arrest any further forward motion. In this stale the bolt is not locked closed. In this state two downward projections (not shown) on locking toggle 12 lie in front of flange 26 on firing pin 24. Even if the trigger is pulled and the hammer is released, the firing pin cannot move forward. And—even if the firing pin is somehow moved forward—it cannot span the gap created by the ring protrusion and strike the primer. In other words, the weapon simply cannot fire if a conventional round is chambered.

FIG. 11 shows the same Model 870 action in a locked state—ready to fire. The action bars have moved slide tug 66 fully forward. Locking toggle 12 has popped upward so that locking lug 64 is engaged with the locking recess in the barrel extension. The locking toggle is held in this upward position by the slide lug resting beneath it. The forward portion of locking toggle 12 bears against the upper front of the locking toggle passage and thereby holds the breech bolt in the forward position. The slide lug bears against the lower front of the locking toggle passage and further secures the breech bolt.

In this state the firing pin is free to move forward when struck by the hammer. The reader should note how ring protrusion 22 extends well forward of the bolt face and into the firing chamber. The position shown in FIG. 11 can only be achieved with a modified cartridge (including a ring recess) or an empty chamber.

Now understanding the basic operating principles of the invention, the reader may wish to know some additional details regarding the shape of the ring protrusion and ring recess. Those skilled in the art will know that manufacturing tolerances for centerfire cartridges are established by the Sporting Arms and Ammunition Manufacturers' Institute ("SAAMI"). Tolerances for shotgun shells are fairly loose in comparison to centerfire rifle cartridges. For example, the rim thickness of a 12 gauge shell can vary between 0.0576 and 0.0716 inches (1.463 and 1.819 mm) and still fell within the specification. Head diameter tolerances are supposed to lie between 0.800 and 0.809 inches (20.320 and 20.549 mm) but in practical experience the head diameter may be as small as 0.785 inches (19.939 mm). Variations in hull diameter are even more extreme. Most shells also taper somewhat when proceeding from the base toward the extreme end of the hull.

These variations mean that a shotgun shell may lie somewhat off the center of the firing chamber (owing to head diameter tolerances). Further, it is not uncommon for a shotgun shell to be somewhat "tipped" when it is loaded in the chamber—meaning that the centerline of the shell is angularly displaced from the centerline of the chamber. A shell with a tapered hull will inevitably be somewhat tipped. Thus, it is not always easy to ensure that the inventive ring protrusion on the bolt face slips into the ring recess on the base of a modified cartridge.

Figure 12:
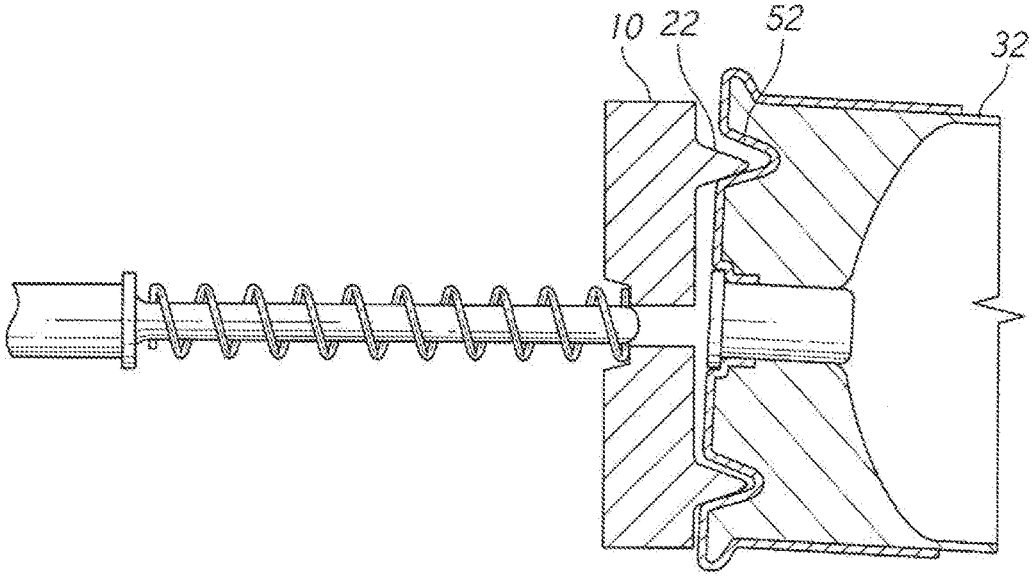
FIG. 12 is a sectional elevation view, showing how the inventive bolt engages an inventive shotgun shell.

FIG. 12 graphically depicts this issue. The reader will note that shotgun shell 32 is somewhat inclined with respect to breech bolt 10 (It is "tipped"). The tapered nature of ring protrusion 22 and ring recess 52 allows the bolt to promote the alignment of the modified shell as the bolt moves into its locked position.

Figure 13:
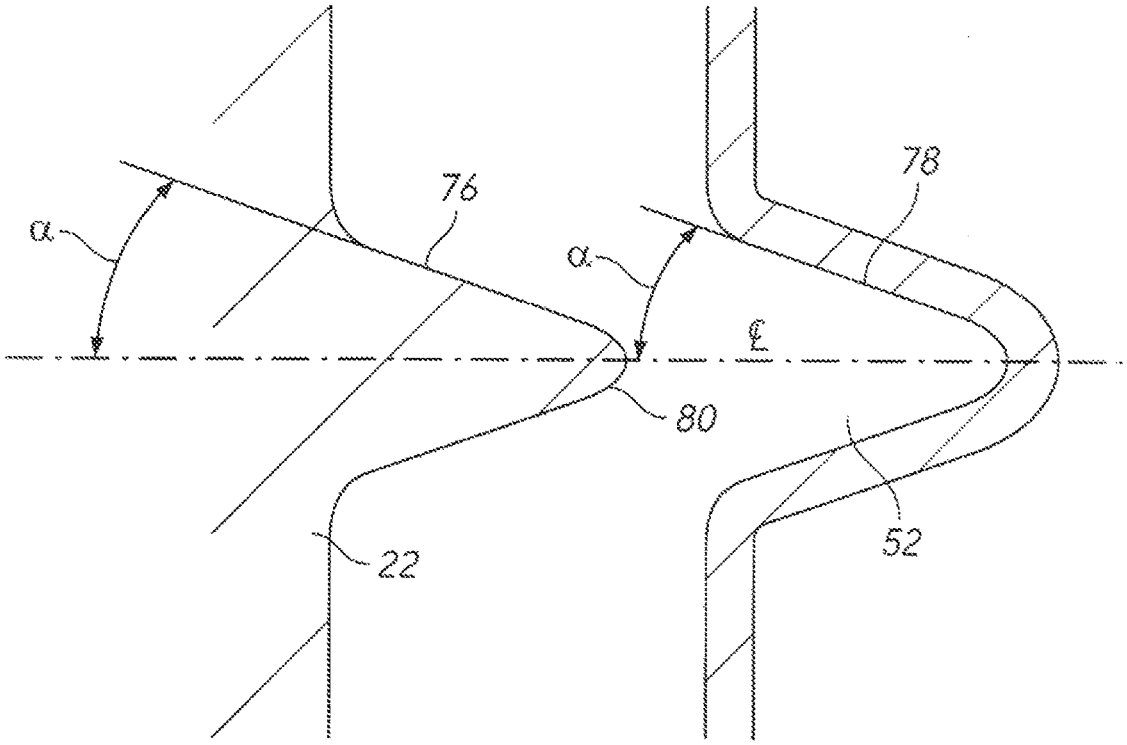
FIG. 13 is a detailed sectional elevation view, showing how the angled walls on the ring protrusion facilitate engagement with the ring recess on base of a shotgun shell.

FIG. 13 shows a detailed view of both ring protrusion 22 and ring recess 52. Ring protrusion 22 includes angled wall 76 and ring recess 52 includes a corresponding angled wall 78. Each preferably includes a fillet 80 as well—in order to aid manufacturing and minimize stress concentrations. The angle $\alpha$ can be any angle suitable for promoting the alignment of the ring protrusion, and ring recess as the two elements are moved together. The angle is preferably between 5 and 60 degrees and even more preferably between 10 and 30 degrees.

Although the angled walls for both the ring protrusion and the ring recess are shown as being symmetric about the centerline, this need not always be the case. As an example, the angle between the centerline and the upper angled walls in the view might be 20 degrees and the angle between the centerline and the lower angled walls might be between 0 and 10 degrees. These relationships may also be reversed, with the upper angle being between 0 and 10 degrees.

Further, the angles used in the ring protrusion need not perfectly match those used in the ring recess. Some manufacturing tolerances will always be present. As long as the interface between the protrusion and the recess allows the bolt to fully close, the variations are acceptable.

The two angled walls 76 shown in FIG. 13 may be referred to as an inner angled wall and an outer angled wall. The inner angled wall is on the side nearest the firing pin aperture. The outer angled wall is the opposite side. The angle between the inner angled wall and the outer angled wall will generally be two times the angle "alpha."

The base of the ring protrusion is of course its widest point. At that widest point the ring protrusion may be said to have an inner diameter and an outer diameter. The inner diameter corresponds to the circular intersection between the ring protrusion and the bolt face that is closest to the firing pin aperture. The outer diameter corresponds to the circular intersection between the ring protrusion and the bolt face that is farthest from the firing pin aperture. The inner diameter is preferably made large enough so that no portion of the ring protrusion makes contact with the primer of the centerfire cartridge. The outer diameter is preferably made small enough so that no portion of the ring protrusion makes contact with the extractor claw.

In the orientation of FIG. 13, the left-most extreme of the ring protrusion is referred to as the base and the right-most extreme is referred to as the lip. The distance between the base and the tip will vary depending on the firearm in question. The preferred range for the distance is between 0.070 and 0.200 inches (1.7 mm and 5.0 mm).

The ring protrusion and ring recess can each be manufactured using a wide variety of techniques. The ring protrusion can be manufactured as an integral part of the bolt—such as by machining away a portion of the bolt face other than the ring. The ring protrusion may also be made as a separate piece that is added to the bolt.

Figure 14:
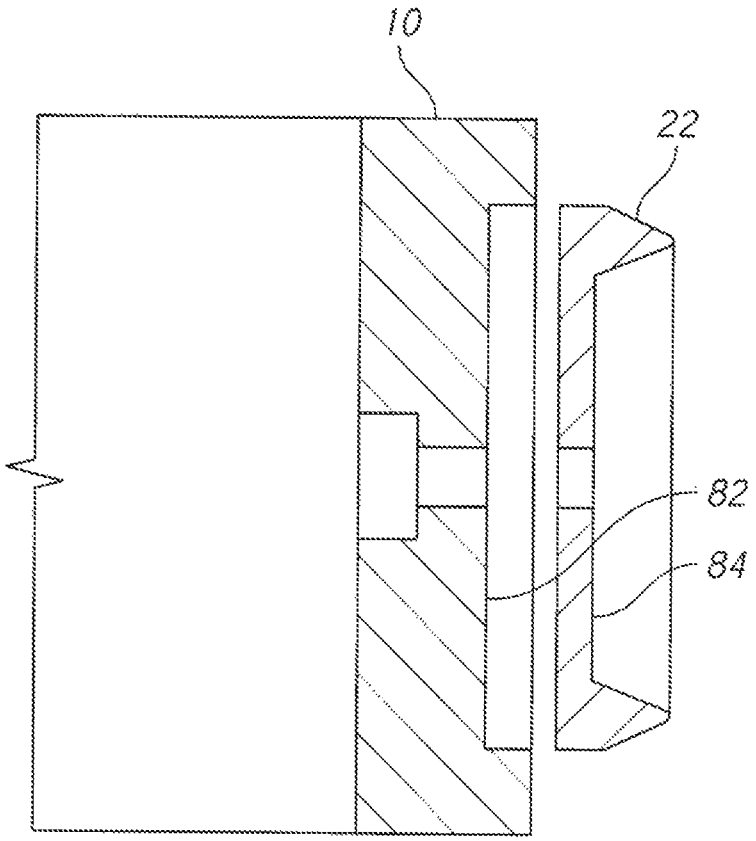
FIG. 14 is a sectional elevation view, showing an alternate embodiment in which the ring protrusion is made as a separate piece.

FIG. 14 illustrates one approach to manufacturing the ring protrusion as a separate piece. Those skilled in the art will know that firearm bolts are subjected to a harsh operating environment. They are often machined from hot forgings. They are also often subjected to tempering treatments to prevent the formation of stress cracks. The result is a very tough material but one that may not be overly hard.

On the other hand, the ring protrusion itself must engage the ring recess in a modified cartridge and the tip of the ring protrusion will be subjected to cyclic wear. The ring protrusion could be made of a harder material to reduce wear. As an example, the ring protrusion could be made of tempered tool steel.

FIG. 14 is a sectional elevation view showing a breech bolt 10 with a recess 82 milled into its face. This recess is sized to receive a separately machined insert 84. The insert includes ring protrusion 22. The two components may be joined by brazing or some other suitable means to create a unified assembly. The two components might also be joined using a thread or a press fit. In this latter approach the insert could be made removable so that it could periodically be replaced without having to replace the bolt.

The inventive bolt will prevent the use of traditional "go/no-go" gauges. As those skilled in the art will know, proper head spacing of a firearm is often verified using a set of gauges. The term "head space" means the distance between the bolt face and the surface of the firing chamber that determines the longitudinal position of a cartridge. For a shotgun shell, headspace is the distance from, the bolt face to the forward shoulder of the rim recess. A "go" gauge is an inert (generally metal) object having the precise shape of the cartridge case being tested. It represents the maximum allowable headspace. A properly head-spaced firearm should just be able to close on the "go" gauge.

A "no-go" gauge also has the precise shape of the cartridge being tested, but it is made slightly too long in the headspace dimension. A properly head-spaced firearm should not be able to close on the "no-go" gauge.

Gun makers, armorers, and gunsmiths routinely use "go/no-go" gauges in the maintenance and construction of firearms. If the breech bolt is modified with a ring protrusion (as in the preferred embodiments), the bolt will not be able to close on either the "go" or the "no-go" gauges. This is true because the gauges have a flat base and do not include a ring recess. It may therefore be desirable to provide a set of modified gauges that include the ring recess.

The reader will thereby understand that the present invention presents an inventive firearm that can only fire a modified cartridge. The modified cartridge can obviously be fired by the inventive firearm. The modified cartridge can also be fired by a prior art conventional firearm.

The preferred embodiments include a ring protrusion on the bolt face and a ring recess in the cartridge base as described and illustrated. Many other embodiments are possible. As a first example, one could provide the ring protrusion on the base of the cartridge and provide the ring recess in the bolt face. The operation of this alternate embodiment would be similar to the embodiments described previously.

The general concept of the invention is to provide a first geometric feature on the breech bolt and a corresponding second geometric feature on the modified cartridge. These two features engage in order to allow the inventive bolt to close on a modified cartridge (but not on an unmodified cartridge). The geometric features may assume many different forms. The term "modified cartridge" should be understood broadly to encompass a cartridge including an additional geometric feature configured to engage a corresponding geometric feature on an inventive breech bolt.

Figure 15:
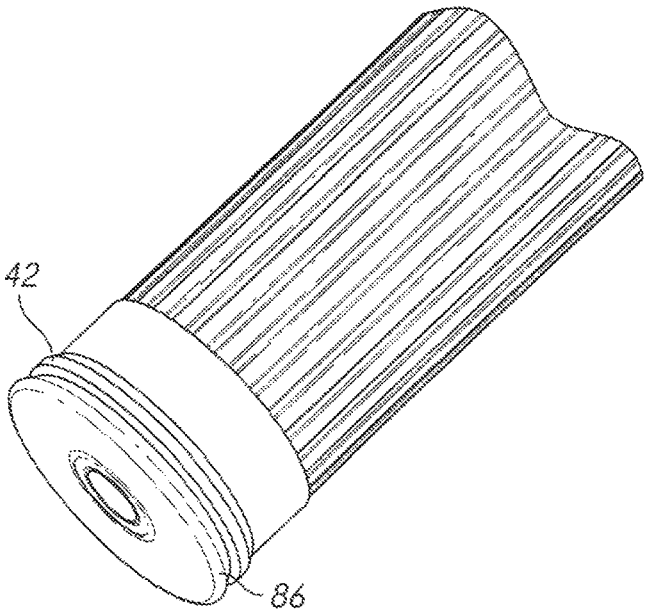
FIG. 15 is a perspective view, showing an alternate embodiment of a modified cartridge.
Figure 16:
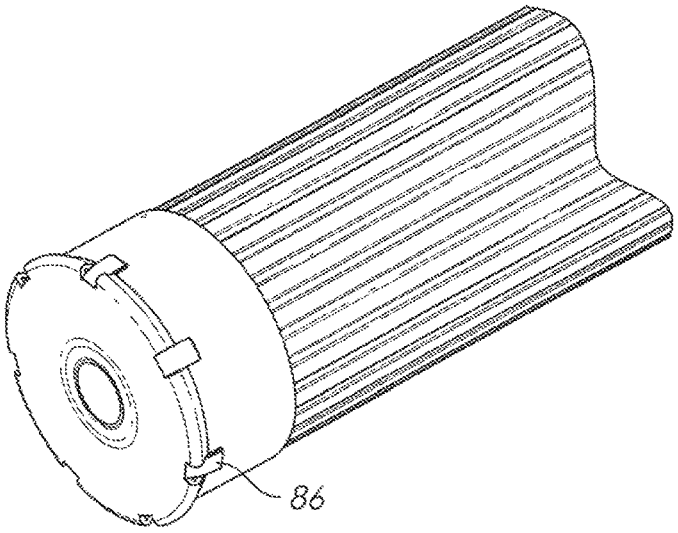
FIG. 16 is a perspective view, showing another alternate embodiment of a modified cartridge.

FIGS. 15 and 16 depict additional alternate embodiments including different geometric features. FIG. 15 shows a modified cartridge in which bead extension 86 has been added to the rear of rim 42. The head extension may be created though the addition of a "washer" that is pressed or glued onto the existing case. It could also be created by deforming the original case head into the shape shown. The modified cartridge will continue to be located in the firing chamber by rim 42. The head extension will then prevent the closure of a normal breach bolt. A modified breach bolt can be created, however, with a recess in the bolt face to accept head extension 86.

FIG. 16 shows a different approach. Portions of the shell rim are pinched or crimped to create supplemental standoffs 88. The forward portions of these standoffs bear against the head-spacing surface of the rim recess. The result is that the cartridge base protrudes to the rear of its normal position and will not allow an unmodified breech bolt to close. An additional recess must be added to the bolt face to accommodate the cartridge base and allow the modified breech bolt to close.

The cartridge base in all the illustrated embodiments retains a substantial area that is flat and undeformed. As an example, even the embodiment of FIG. 6 (including the ring recess) retains a significant flat section between the ring recess and the outer perimeter of the rim. A substantial flat section is also retained between the inner portion of the ring recess and the primer pocket. These retained flat areas can be used for identifying markings (a "headstamp"). SAAMI specifications define a "headstamp" as "numerals, letters, and symbols (or combinations) stamped into the head of a cartridge case or shotshell to identify the manufacturer, caliber or gage, and other additional information." The inventive cartridge designs allow for the continued use of a headstamp and this is a significant feature.

The preceding description contains significant detail regarding the novel aspects of the present invention. It should not be construed, however, as limiting the scope of the invention but rather as providing illustrations of the preferred embodiments of the invention. Accordingly, the scope of the invention should be determined by reference to the claims ultimately presented rather that the examples given.

Having described my invention, I claim:

1. A firearm configured for use with a centerfire cartridge, said cartridge having a base, a central axis and a primer having a primer diameter located in said base and being aligned with said central axis, said firearm comprising:

a. a breech bolt, including a planar bolt face configured to mate against said base of said centerfire cartridge, wherein said bolt face includes a recess;

b. a firing pin aperture in said bolt face, said firing pin aperture housing a firing pin with a nose that is recessed behind said bolt face;

c. a ring protrusion extending forward from said bolt face and centered on said firing pin aperture, wherein said ring protrusion is part of an insert configured to fit within said recess in said bolt face;

d. said ring protrusion having a base and a tip; and e. said ring protrusion narrowing from said base to said tip.

2. The firearm as recited in claim 1, wherein said ring protrusion narrows from said base to said tip in a linear taper.

3. The firearm as recited in claim 2, wherein:

a. said ring protrusion includes an inner angled wall and an outer angled wall; and b. an angle between said inner angled wall and said outer angled wall is between 20 and 60 degrees.

4. The firearm as recited in claim 1, wherein:

a. said ring protrusion includes an inner diameter and an outer diameter; and b. said inner diameter is larger than said primer diameter.

5. The firearm as recited in claim 4, wherein:

a. said breech bolt includes an extractor; and b. said outer diameter is small enough to remain clear of said extractor.

6. The firearm as recited in claim 1, wherein a distance between said base and said tip of said ring protrusion is between 1.7 mm and 5.0 mm.

7. A breech bolt for use in a firearm configured for use with a centerfire cartridge, said centerfire cartridge having a base, a central axis and a primer having a primer diameter located in said base and being aligned with said central axis, said breech bolt comprising:

a. a planar bolt face configured to mate against said base of said centerfire cartridge, wherein said bolt face includes a recess;

b. a firing pin aperture in said bolt face, said firing pin aperture housing a firing pin with a nose that is recessed behind said bolt face;

c. a ring protrusion extending forward from said bolt face and centered on said firing pin aperture, wherein said ring protrusion is part of an insert configured to fit within said recess in said bolt face;

d. said ring protrusion having a base and a tip; and e. said ring protrusion narrowing from said base to said tip.

8. The breech bolt as recited in claim 7, wherein said ring protrusion narrows from said base to said tip in a linear taper.

9. The breech bolt as recited in claim 8, wherein:

a. said ring protrusion includes an inner angled wall and an outer angled wall; and b. an angle between said inner angled wall and said outer angled wall is between 20 and 60 degrees.

10. The breech bolt as recited in claim 7, wherein:

a. said ring protrusion includes an inner diameter and an outer diameter; and b. said inner diameter is larger than said primer diameter.

11. The breech bolt as recited in claim 10, wherein:

a. said breech bolt includes an extractor; and b. said outer diameter is small enough to remain clear of said extractor.

12. The breech bolt as recited in claim 7, wherein a distance between said base and said tip of said ring protrusion is between 1.7 mm and 5.0 mm.

13. A firearm configured for use with a centerfire cartridge, said centerfire cartridge having a base, a central axis and a primer having an outer primer diameter located in said base and being aligned with said central axis, comprising:

a. a breech bolt, including a bolt face configured to mate against said base of said centerfire cartridge, wherein said bolt face includes a recess;

b. a firing pin aperture in said bolt face, said firing pin aperture housing a firing pin with a nose that is recessed behind said bolt face;

c. a ring protrusion extending forward from said bolt face and centered on said firing pin aperture, wherein said ring protrusion is part of an insert configured to fit within said recess in said bolt face;

d. said ring protrusion having a base and a tip; and e. said ring protrusion being wider at said base than said tip.

14. The firearm as recited in claim 13, wherein said ring protrusion narrows from said base to said tip in a linear taper.

15. The firearm as recited in claim 14, wherein:

a. said ring protrusion includes an inner angled wall and an outer angled wall; and b. an angle between said inner angled wall and said outer angled walls is between 20 and 60 degrees.

16. The firearm as recited in claim 13, wherein:

a. said ring protrusion includes an inner diameter and an outer diameter; and b. said inner diameter is larger than said primer diameter.

17. The firearm as recited in claim 16, wherein:

a. said breech bolt includes an extractor; and b. said outer diameter is small enough to remain clear of said extractor.

* * * * *